US008245779B2

(12) United States Patent
Lemke et al.

(10) Patent No.: US 8,245,779 B2
(45) Date of Patent: Aug. 21, 2012

(54) CENTRALIZER APPARATUS

(75) Inventors: John Lemke, Sacramento, CA (US); Lars Pedersen, Davis, CA (US)

(73) Assignee: Geodaq, Inc., Sacramento, CA (US)

( * ) Notice: Subject to any disclaimer, the term of this patent is extended or adjusted under 35 U.S.C. 154(b) by 426 days.

(21) Appl. No.: 12/537,989

(22) Filed: Aug. 7, 2009

(65) Prior Publication Data

US 2011/0030945 A1 Feb. 10, 2011

(51) Int. Cl.
*E21B 17/10* (2006.01)
*E21B 47/022* (2006.01)

(52) U.S. Cl. ..... 166/241.6; 175/325.3

(58) Field of Classification Search ..... 166/241.1, 166/241.6, 255.1; 175/325.3, 325.1
See application file for complete search history.

(56) References Cited

U.S. PATENT DOCUMENTS

| | | | | |
|---|---|---|---|---|
| 1,132,691 | A | 3/1915 | Sieben | |
| 1,293,777 | A * | 2/1919 | Hogue | 166/105 |
| 1,898,074 | A | 2/1933 | Bailey | |
| 2,742,259 | A | 4/1956 | Boucher | |
| 2,887,118 | A | 5/1959 | Loeffler et al. | |
| 4,073,302 | A | 2/1978 | Jones | |
| 4,218,923 | A * | 8/1980 | Triplett et al. | 73/623 |
| 4,537,136 | A | 8/1985 | Douglas | |
| 4,557,327 | A | 12/1985 | Kinley et al. | |
| 4,611,405 | A | 9/1986 | Van Steenwyk | |
| 4,619,322 | A | 10/1986 | Armell et al. | |
| 4,790,381 | A | 12/1988 | Armell | |
| 4,830,105 | A | 5/1989 | Petermann | |
| 4,843,896 | A * | 7/1989 | Napeloni et al. | 73/866.5 |
| 5,005,642 | A | 4/1991 | Moore | |
| 5,096,262 | A * | 3/1992 | Foullois | 299/55 |
| 5,355,950 | A * | 10/1994 | Zwart | 166/241.6 |
| 5,358,039 | A | 10/1994 | Fordham | |
| 5,358,040 | A | 10/1994 | Kinley et al. | |
| 5,758,723 | A | 6/1998 | Saucier et al. | |
| 5,785,125 | A | 7/1998 | Royer | |
| 5,971,404 | A | 10/1999 | Stoves | |
| 6,041,509 | A | 3/2000 | Shelyago | |
| 6,216,779 | B1 | 4/2001 | Reinhardt | |
| 6,629,568 | B2 | 10/2003 | Post et al. | |
| 6,842,990 | B2 | 1/2005 | Taylor | |
| 7,090,007 | B2 | 8/2006 | Stuart-Bruges et al. | |
| 7,328,475 | B2 | 2/2008 | Smith et al. | |
| 7,505,063 | B1 | 3/2009 | Bastedo et al. | |
| 7,526,971 | B2 | 5/2009 | Mandziuk et al. | |
| 2005/0284221 | A1 | 12/2005 | Danisch et al. | |

OTHER PUBLICATIONS

El In-Place Inclinometer—Copyright Nov. 2007—Slope Indicator Head Office, 12123 Harbour Reach Drive, Mukilteo, WA 98275—http://www.slopeindicator.com/pdf/el%20in-place%20inclinometer%20datasheet.pdf.

Digitilt Inclinometer Probe—Copyright Jul. 2008—Slope Indicator Head Office, 12123 Harbour Reach Drive, Mukilteo, WA 98275—http://www.slopeindicator.com/pdf/digitilt-vertical-inclinometer-probe-datasheet.pdf.

* cited by examiner

*Primary Examiner* — Kenneth L Thompson
(74) *Attorney, Agent, or Firm* — John P. O'Banion

(57) ABSTRACT

A centralizer for an instrument such as an in-place inclinometer is described. The centralizer has a clamp with an inner receptacle configured for coupling to the instrument housing, and a plurality of elongate fingers extending from the clamp that center the instrument in the casing. The fingers carry rollers that fit into grooves in the instrument casing. The fingers are arcuate and provide a spring-like contact force that causes the rollers to abut the instrument casing and stabilize the instrument.

35 Claims, 6 Drawing Sheets

CENTRALIZER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention pertains generally to deploying inclinometers, and more particularly to an apparatus for centering and stabilizing an instrument such as an inclinometer in a casing.

2. Description of Related Art

Inclinometers are devices that are used, for example, to monitor subsurface movements of earth in landslide areas and deep excavations, as well as deformations in structures such as dams and embankments. In order to use an inclinometer, a casing is typically installed in a borehole that passes through areas where movement is to be monitored.

BRIEF SUMMARY OF THE INVENTION

An aspect of the invention is to center and stabilize an instrument such as an inclinometer in a casing. Accordingly, a centralizer apparatus is provided which, in one embodiment, comprises a clamp having an inner receptacle configured for coupling to an instrument; and a plurality of longitudinally aligned elongate fingers extending from the clamp; wherein each finger is convexly arcuate and carries a roller having a contact surface facing radially outward in relation to the longitudinal centerline through the apparatus; and wherein each finger has a tip with a rounded inner surface.

Further aspects and embodiments of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Figure 1:
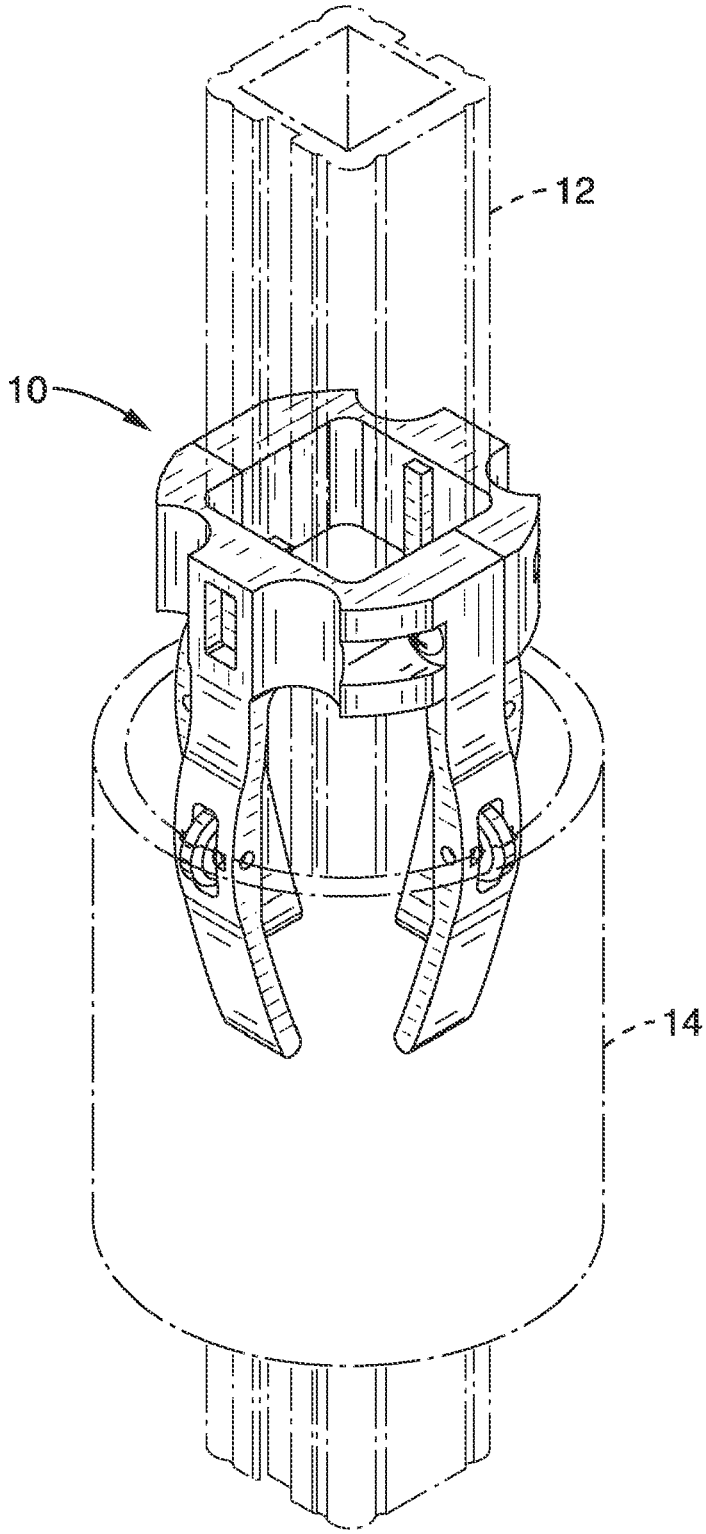
FIG. 1 is a perspective view of an embodiment of a centralizer apparatus according to the present invention, shown attached to an inclinometer housing and further shown partially inserted into an inclinometer casing for context.
Figure 2:
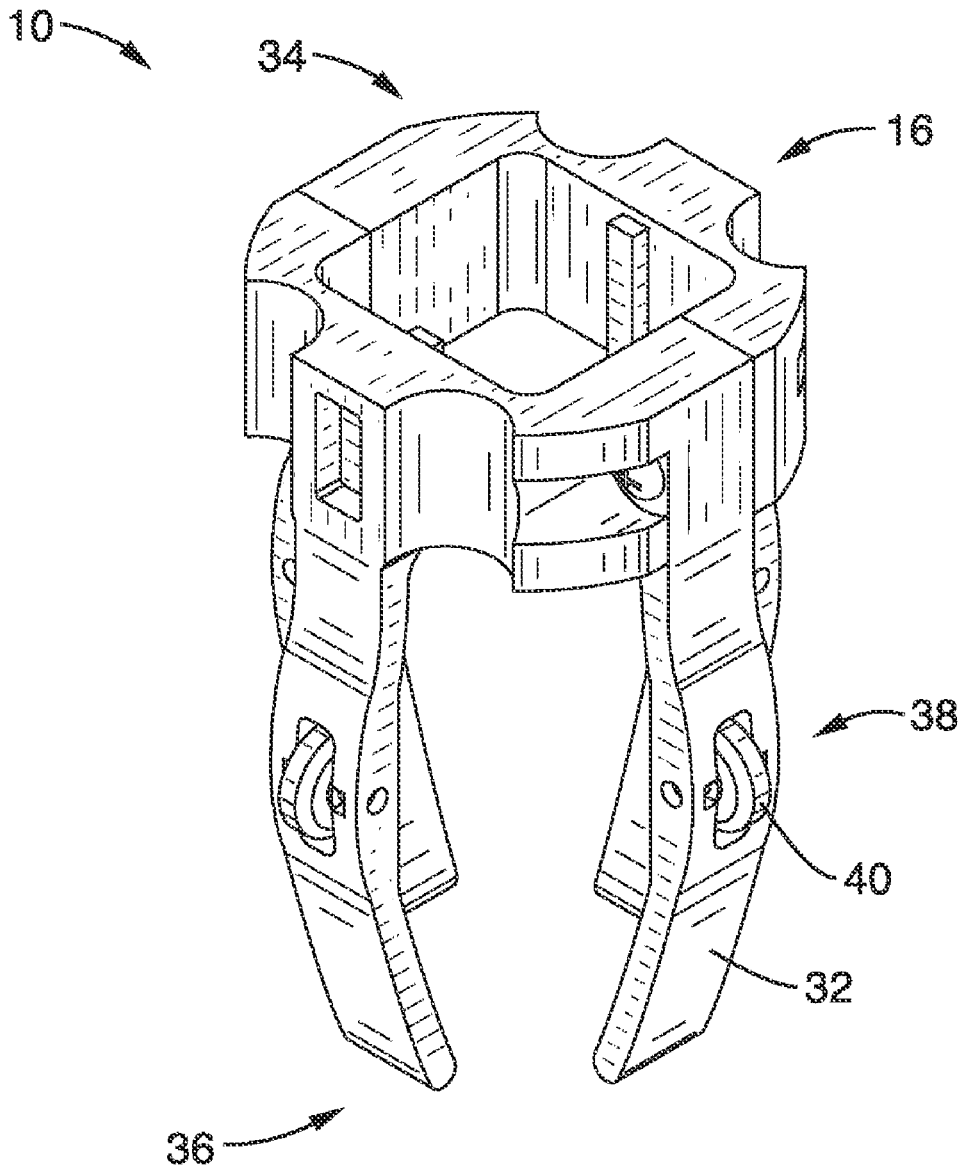
FIG. 2 is a perspective view of the embodiment of the inventive centralizer apparatus shown in FIG. 1.

Referring first to FIG. 1, an embodiment of a centralizer apparatus 10 is shown attached to an inclinometer housing 12 which is in turn inserted into an inclinometer casing 14. Note that inclinometer housing 12 and inclinometer casing 14 are illustrated using phantom lines since those structures are not a part of the invention and are shown for context only. Note also that the inclinometer is shown as one example of an instrument to which the apparatus can be coupled, and that the apparatus can be used with other instruments as well.

Referring also to FIG. 2 through FIG. 10, details of this embodiment of the centralizer apparatus 10 are illustrated. In the embodiment shown, centralizer apparatus 10 includes a clamp 16 which allows for attachment to the inclinometer housing 12. The clamp 16 allows for placement of the centralizer apparatus 10 at any location and at any number of locations along the length of the inclinometer housing 12. A simple to use and cost effective clamping mechanism comprises a pair of separable plastic clamp members 16*a*, 16*b* which are joined together using fasteners 20, 22 such as plastic thread-cutting screws which extend through guide holes 24, 26 and into pilot holes 28, 30, respectively. By sizing the interior space between clamp members 16*a*, 16*b* smaller than the inclinometer housing 12, tightening fasteners 20, 22 will compress the clamp members against the inclinometer housing and affix the centralizer apparatus to the inclinometer housing.

In alternative embodiments, one or more threaded rivets could be inserted or molded into the clamp members, thereby allowing use of machine screws instead of self-tapping screws. This approach could extend the life of the centralizer apparatus for situations where it is advantageous to install and remove the centralizer apparatus multiple times. In further embodiments, a machine screw with a head suitable for finger tightening would simplify field installation eliminating the need for wrenches or power screw drivers. Accordingly, it will be appreciated that various forms of conventional fastening means could be used to affix the centralizer apparatus to the inclinometer housing.

A plurality of elongate fingers 32 extend from clamp 16 such that centralizer apparatus 10 has proximal 34 and distal 36 ends. Each finger 32 is oriented along an axis that is generally parallel to the longitudinal axis of each other finger, such that the fingers are longitudinally aligned relative to each other, and are also aligned generally parallel to the longitudinal axis of the inclinometer housing and the inclinometer casing. In the embodiment shown, the central portion 38 of each finger 32 extends radially outward in relation to the longitudinal centerline through the apparatus, thereby giving each finger 32 a convexly arcuate shape. In addition, each finger 32 is made from a resilient material such as plastic and have a spring-like characteristic when compressed. Accordingly, when the central portion 38 is compressed radially inward toward the inclinometer housing, each finger 32 will provide an opposing outward force.

By using a plurality of outwardly convex, spring-like, fingers 32 as shown and described, a spring force can be maintained between the contact surface of rollers 40 and the corresponding contact surface of internal grooves 42 in the inclinometer casing, in a direction that is generally normal to the contact surface of the internal grooves. This force supports the inclinometer housing in the center of the inclinometer casing, and maintains alignment with the internal grooves of the inclinometer casing. The internal grooves 42 in the inclinometer casing are illustrated most clearly in FIG. 9 and FIG. 10.

In the preferred embodiment, four fingers 32 are positioned at an approximate ninety degree spacing relative to each other; namely, there are two pairs of opposing fingers. This configuration is intended to match an inclinometer casing having four internal grooves 42 molded or machined on the inside of the casing at ninety degree arc intervals. Use of four fingers 32, and associated rollers 40, allows for stable coupling within the inclinometer casing in two directions that are orthogonal to each other. This provides stable coupling of the inclinometer housing to the inclinometer casing when movement of the inclinometer casing occurs in any direction. It also provides stable coupling within the inclinometer casing when the direction of motion to be measured changes over time; e.g., when measuring the dynamic movements associated with an earthquake or impact loading event.

In an alternative embodiment, two opposing fingers 32 with associated rollers 40 could be employed, with the fingers and rollers positioned at approximately one hundred and eighty degree spacing. This type of configuration would allow for additional free space between the inclinometer housing and the inclinometer casing for other cables, instruments, or devices.

The rollers 40 reduce friction between the fingers 32 and inclinometer casing 14, thus allowing the inclinometer housing 12 to be installed or moved through the inclinometer casing 14. Stainless steel is preferred over plastic for the roller material because of better wear characteristics at the axle roller well interface. Stainless steel also offers corrosion protection for installations in salt water (marine environments) or moist or submerged installations. Each roller has a pair of tapered sides 44*a*, 44*b* to allow for varying shape and width of grooves 42 that occurs due to manufacturing tolerances.

Figure 3:
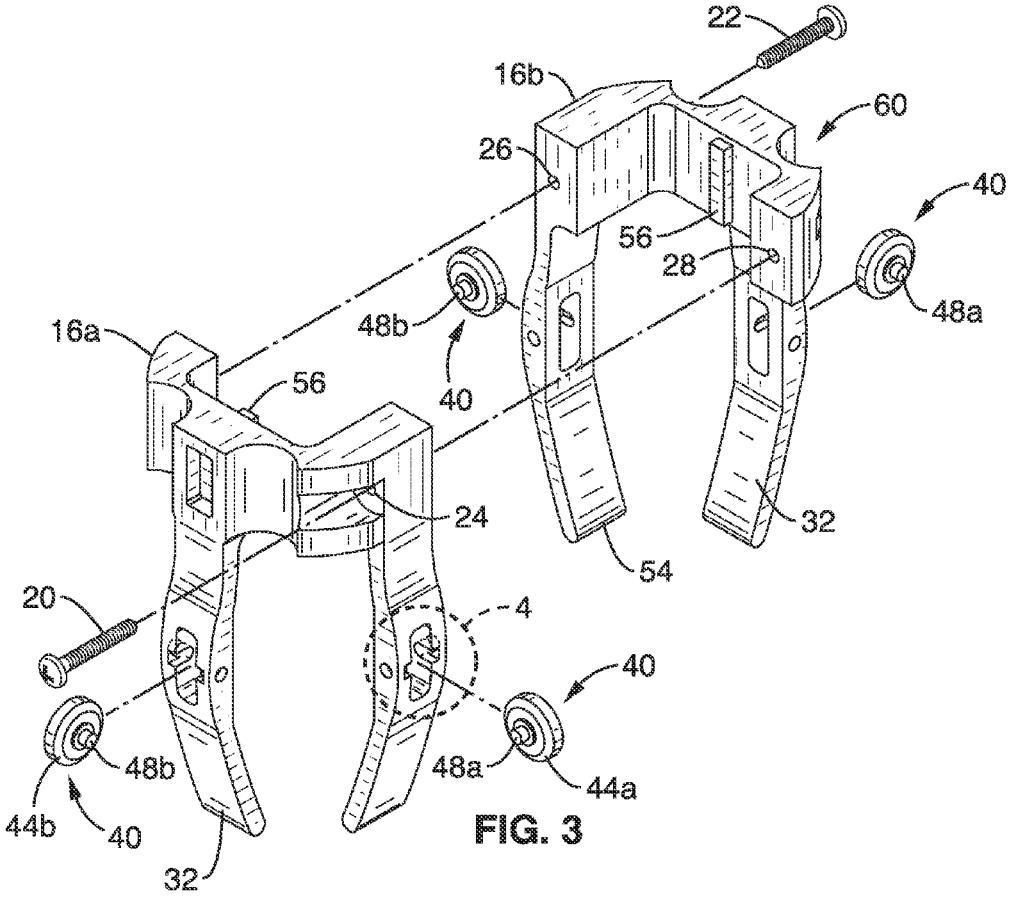
FIG. 3 is an exploded view of the embodiment of the inventive centralizer apparatus shown in FIG. 2.
Figure 4:
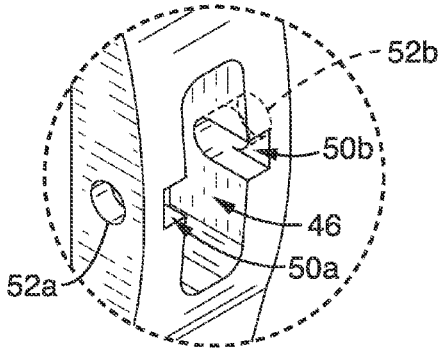
FIG. 4 is a detail view of the roller receptacle shown in FIG. 3.
Figure 5:
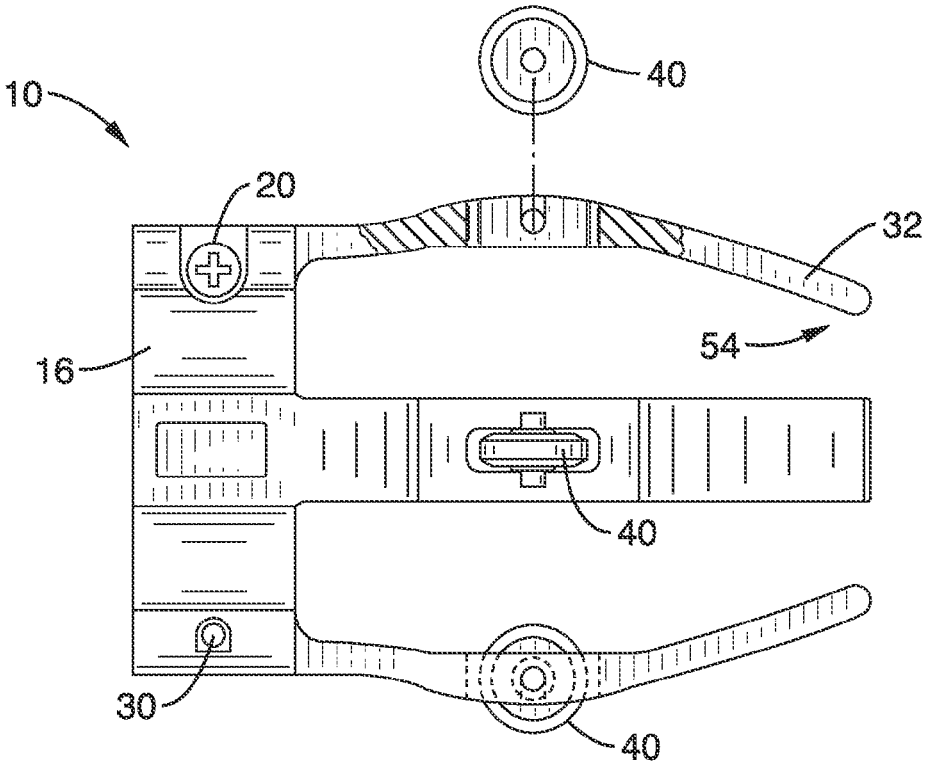
FIG. 5 is a front view of the embodiment of the inventive centralizer apparatus shown in FIG. 2 with a spring finger shown in partial cutaway and the associated roller exploded away from the spring finger.
Figure 6:
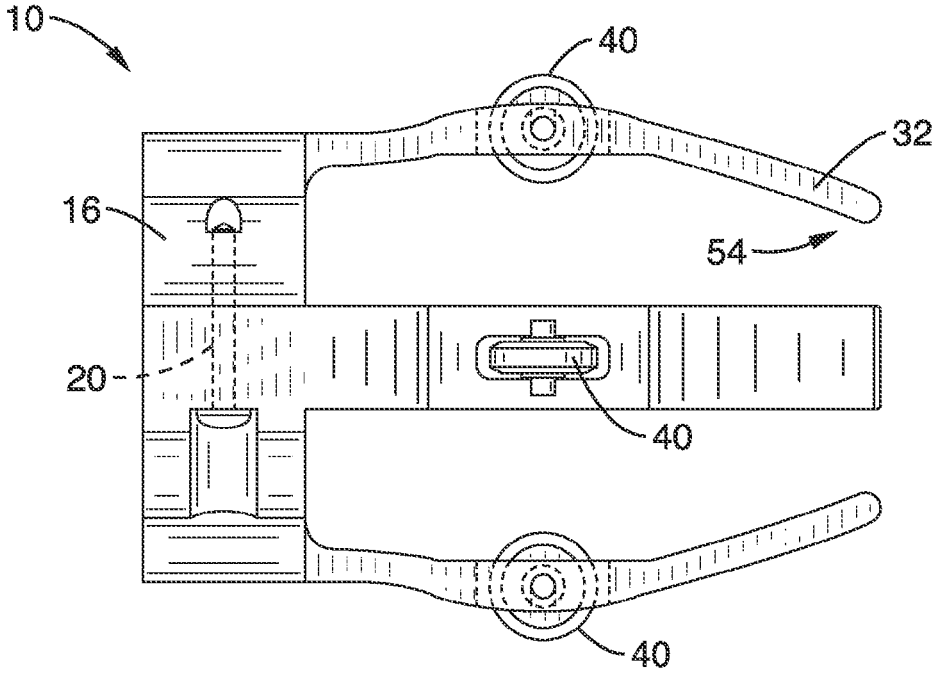
FIG. 6 is a side view of the embodiment of the inventive centralizer apparatus shown in FIG. 2.
Figure 7:
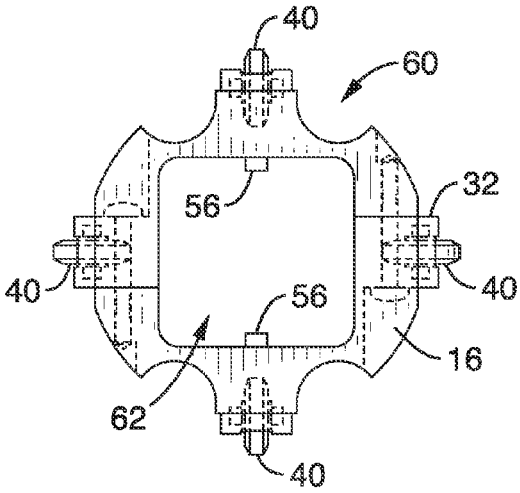
FIG. 7 is a top view of the embodiment of the inventive centralizer apparatus shown in FIG. 2.
Figure 8:
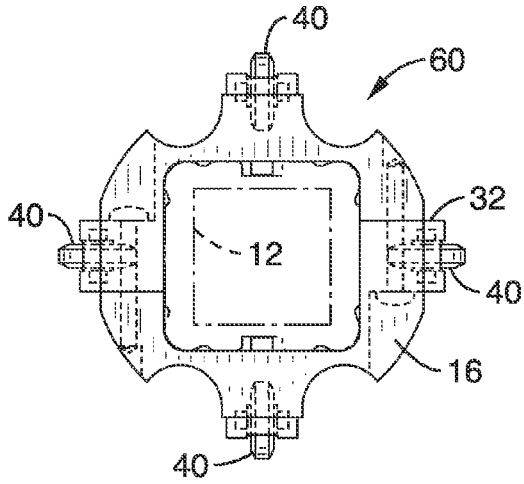
FIG. 8 is a top view of the embodiment of the inventive centralizer apparatus shown in FIG. 2, further shown attached to an inclinometer housing for context.
Figure 9:
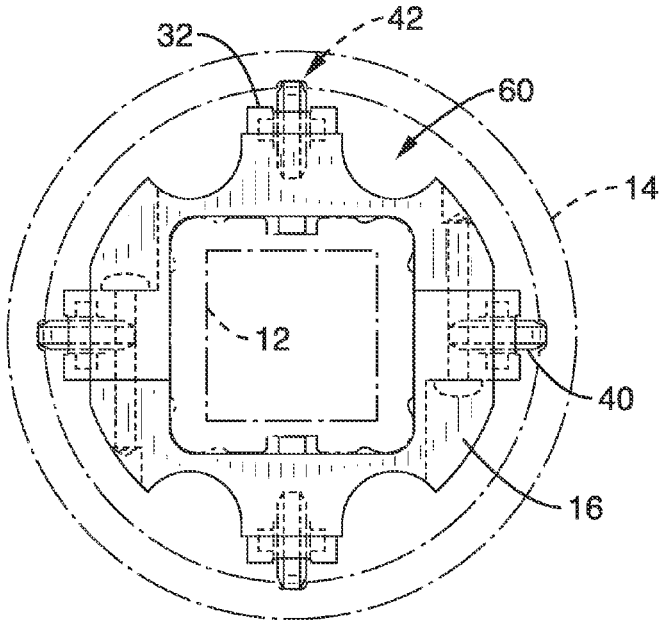
FIG. 9 is a top view of the embodiment of the inventive centralizer apparatus shown in FIG. 2, further shown attached to an inclinometer housing and inserted into an inclinometer casing for context.
Figure 10:
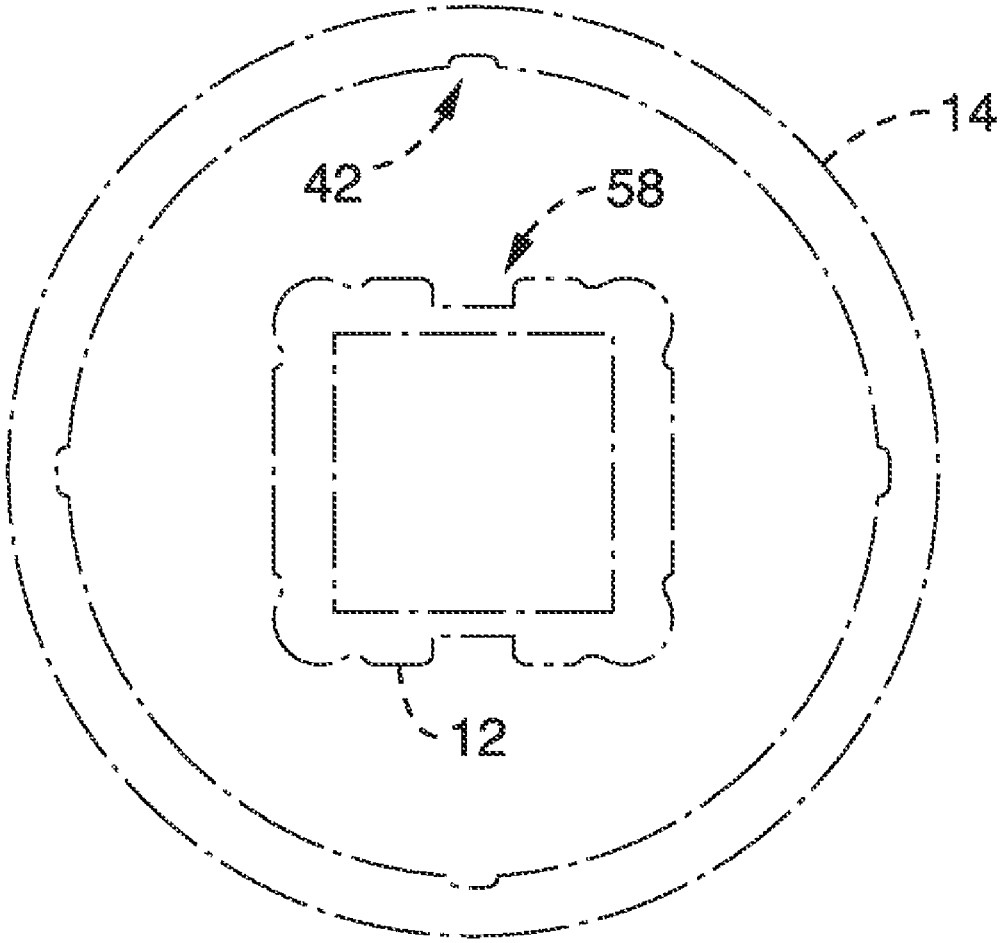
FIG. 10 is a top view of the inclinometer housing and casing shown in FIG. 9 with the centralizer apparatus removed for context.

Referring more particularly to FIG. 3 and FIG. 4, each roller 40 is retained in a corresponding well 46 that is positioned in the central portion 38 of a corresponding finger 32. Each of roller has a pair of axles 48*a*, 48*b* that snap into corresponding couplings 50*a*, 50*b*. Holes 52*a*, 52*b* may be provided for retaining the axles and providing a bearing surface, in which case the inner opposing walls of a well would be slightly spread apart to snap a roller into place. Alternatively the couplings can provide the retaining and bearing surfaces internal to the wells. Each roller is oriented in its corresponding finger such that the roller has a contact surface that faces radially outward from the finger in relation to the longitudinal centerline through the apparatus The snap-in roller couplings provide an economical way to manufacture the centralizer apparatus with rollers using a plastic molded part manufacturing method. The snap-in couplings also allow the rollers to be easily installed on the fingers. Because the wells 46 open toward the outside of the fingers and, therefore, the rollers bear against the inside wall of the inclinometer casing, the well orientation ensures that the rollers remains in place when the centralizer apparatus is inside the inclinometer casing. Other means for coupling the rollers to the fingers could be employed as well.

In the embodiment shown, each finger 32 has a rounded inner surface 54 at its tip to facilitate longitudinal movement along the surface of the inclinometer housing. It will be appreciated that this configuration allows the tips of the fingers to easily slide along the surface of the inclinometer housing so that the spring function will work without binding. Additionally, each finger 32 curves inward toward its tip to facilitate placement into, and movement inside of, the inclinometer casing. In an alternative embodiment, rollers could be added to the tips to reduce friction between the fingers and the inclinometer housing or other device.

The size and shape of the fingers and rollers could be changed to accommodate different casing sizes (diameters). In addition, the fingers could be modified to allow a single model centralizer to be used in a variety of casing sizes, so different centralizer parts would not be needed to accommodate different casing sizes.

In other embodiments, large radius rounded fins could be molded into the fingers to provide a guide to track the internal grooves of the inclinometer. In such embodiments, the centralizer apparatus preferably would be fabricated from a material having low friction characteristics to facilitate sliding along the inside of the inclinometer housing. This would eliminate the need for rollers and the secondary manufacturing step of installing the rollers.

At least one alignment tab 56 may be included in clamp 16 to mate with a corresponding groove 58 in inclinometer housing 12. The alignment tab helps to ensure that centralizer apparatus is installed in the same orientation on inclinometer housing. For embodiments with only two fingers and rollers, the alignment tab ensures that the fingers and rollers are installed on the correct sides.

At least one concave depression 60 may be included as a cable access channel to allow a signal/power cable to pass the centralizer apparatus, and preferably there is a concave depression 60 at all four quadrants of clamp 16 to allow for up to four signal/power cables to pass. This feature allows multiple inclinometer networks to be installed in the same inclinometer casing, which in turn allows for very long inclinometer installations. The cable access channel can also be used to pass cables for additional instrumentation to be installed with the inclinometer such as piezometers or other sensors used to measure various properties of water.

In the embodiment shown, clamp 16 has an inner receptacle 62 that is of a generally square cross-section that corresponds to the cross-sectional shape of the inclinometer housing that is also shown. However, the size and shape of the inside surface of the clamp could be changed to accommodate an inclinometer housing, other instrumentation string, or any device with a different cross-sectional shape to be installed inside an inclinometer casing.

The fingers could be outfitted with internally or externally mounted strain gauges to provide a means to measure lateral forces or motions using the mass of the inclinometer housing (or other instrumentation or device) together with the spring stiffness of the fingers. In addition, the integral finger sensor could be calibrated and used to correct acceleration measurements obtained from sensors inside the inclinometer housing during seismic, vibration, or dynamic loading events. The internal strain measurement sensor could be molded into the centralizer part to provide an economical way to add this sensor feature.

From the foregoing, it will be appreciated that the inventive concepts described herein can be implemented in various embodiments, which include but are not limited to the following:

1. A centralizer apparatus, comprising:

a clamp having an inner receptacle configured for coupling to an instrument housing; and a plurality of longitudinally aligned elongate fingers extending from the clamp;

each said finger being convexly arcuate and carrying a roller having a contact surface facing radially outward in relation to a longitudinal centerline through the apparatus;

each said finger having a tip with a rounded inner surface.

2. An apparatus according to embodiment 1, wherein said clamp comprises a pair of separable clamp members.

3. An apparatus according to embodiment 1, wherein said plurality of fingers comprises four fingers positioned at approximately ninety degree spacing.

4. An apparatus according to embodiment 1, wherein said plurality of fingers comprises two fingers positioned at approximately one hundred and eighty degree spacing.

5. An apparatus according to embodiment 1, wherein each roller has a pair of tapered sides.

6. An apparatus according to embodiment 1, wherein each finger includes a well configured for receiving an associated roller with a snap-in coupling.

7. An apparatus according to embodiment 1, wherein said clamp includes an alignment tab configured to mate with a corresponding groove in an instrument housing.

8. An apparatus according to embodiment 1, wherein said clamp includes a cable channel.

9. An apparatus according to embodiment 1, wherein said clamp includes a plurality of cable channels.

10. An apparatus according to embodiment 9, wherein said plurality of cable channels comprises four cable channels.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A centralizer apparatus, comprising:

a clamp having an inner receptacle configured for coupling to an instrument housing; and a plurality of longitudinally aligned elongate fingers extending from the clamp;

each said finger being convexly arcuate and carrying a roller having a contact surface facing radially outward in relation to a longitudinal centerline through the apparatus;

each said finger having a tip with a rounded inner surface;

each said finger including a well configured for receiving an associated roller with a snap-in coupling.

2. An apparatus as recited in claim 1, wherein said clamp comprises a pair of separable clamp members.

3. An apparatus as recited in claim 1, wherein said plurality of fingers comprises four fingers positioned at approximately ninety degree spacing.

4. An apparatus as recited in claim 1, wherein said plurality of fingers comprises two fingers positioned at approximately one hundred and eighty degree spacing.

5. An apparatus as recited in claim 1, wherein each roller has a pair of tapered sides.

6. An apparatus as recited in claim 1, wherein said clamp includes an alignment tab configured to mate with a corresponding groove in an instrument housing.

7. An apparatus as recited in claim 1, wherein said clamp includes a cable channel.

8. An apparatus as recited in claim 1, wherein said clamp includes a plurality of cable channels.

9. An apparatus as recited in claim 8, wherein said plurality of cable channels comprises four cable channels.

10. A centralizer apparatus, comprising:

a clamp having an inner receptacle configured for coupling to an instrument housing;

said clamp comprising a pair of separable clamp members; and a plurality of longitudinally aligned elongate fingers extending from the clamp;

each said finger being convexly arcuate and carrying a roller having a contact surface facing radially outward in relation to a longitudinal centerline through the apparatus;

each said finger having a tip with a rounded inner surface;

each said finger including a well configured for receiving an associated roller with a snap-in coupling.

11. An apparatus as recited in claim 10, wherein said plurality of fingers comprises four fingers positioned at approximately ninety degree spacing.

12. An apparatus as recited in claim 10, wherein said plurality of fingers comprises two fingers positioned at approximately one hundred and eighty degree spacing.

13. An apparatus as recited in claim 10, wherein each roller has a pair of tapered sides.

14. An apparatus as recited in claim 10, wherein said clamp includes an alignment tab configured to mate with a corresponding groove in an instrument housing.

15. An apparatus as recited in claim 10, wherein said clamp includes a cable channel.

16. An apparatus as recited in claim 10, wherein said clamp includes a plurality of cable channels.

17. An apparatus as recited in claim 16, wherein said plurality of cable channels comprises four cable channels.

18. A centralizer apparatus for an inclinometer, comprising:

a clamp having an inner receptacle configured for coupling to an inclinometer housing;

said clamp comprising a pair of separable clamp members; and a pair of longitudinally aligned elongate fingers extending from each clamp member;

each said finger being convexly arcuate and carrying a roller having a contact surface facing radially outward in relation to a longitudinal centerline through the apparatus;

each said roller having a pair of tapered sides;

each said finger including a well configured for receiving an associated roller with a snap-in coupling;

each said finger having a tip with a rounded inner surface;

said clamp including a cable channel.

19. A centralizer apparatus, comprising:

a clamp having an inner receptacle configured for coupling to an instrument housing; and a plurality of longitudinally aligned elongate fingers extending from the clamp;

each said finger being convexly arcuate and carrying a roller having a contact surface facing radially outward in relation to a longitudinal centerline through the apparatus;

each said finger having a tip with a rounded inner surface;

wherein said clamp includes an alignment tab configured to mate with a corresponding groove in an instrument housing.

20. An apparatus as recited in claim 19, wherein said clamp comprises a pair of separable clamp members.

21. An apparatus as recited in claim 19, wherein said plurality of fingers comprises four fingers positioned at approximately ninety degree spacing.

22. An apparatus as recited in claim 19, wherein said plurality of fingers comprises two fingers positioned at approximately one hundred and eighty degree spacing.

23. An apparatus as recited in claim 19, wherein each roller has a pair of tapered sides.

24. An apparatus as recited in claim 19, wherein each finger includes a well configured for receiving an associated roller with a snap-in coupling.

25. An apparatus as recited in claim 19, wherein said clamp includes a cable channel.

26. An apparatus as recited in claim 19, wherein said clamp includes a plurality of cable channels.

27. An apparatus as recited in claim 26, wherein said plurality of cable channels comprises four cable channels.

28. A centralizer apparatus, comprising:

a clamp having an inner receptacle configured for coupling to an instrument housing;

said clamp comprising a pair of separable clamp members; and a plurality of longitudinally aligned elongate fingers extending from the clamp;

each said finger being convexly arcuate and carrying a roller having a contact surface facing radially outward in relation to a longitudinal centerline through the apparatus;

each said finger having a tip with a rounded inner surface;

wherein said clamp includes an alignment tab configured to mate with a corresponding groove in an instrument housing.

29. An apparatus as recited in claim 28, wherein said plurality of fingers comprises four fingers positioned at approximately ninety degree spacing.

30. An apparatus as recited in claim 28, wherein said plurality of fingers comprises two fingers positioned at approximately one hundred and eighty degree spacing.

31. An apparatus as recited in claim 28, wherein each roller has a pair of tapered sides.

32. An apparatus as recited in claim 28, wherein each finger includes a well configured for receiving an associated roller with a snap-in coupling.

33. An apparatus as recited in claim 28, wherein said clamp includes a cable channel.

34. An apparatus as recited in claim 28, wherein said clamp includes a plurality of cable channels.

35. An apparatus as recited in claim 34, wherein said plurality of cable channels comprises four cable channels.

* * * * *